US006555511B2

(12) United States Patent
Renfrow

(10) Patent No.: US 6,555,511 B2
(45) Date of Patent: Apr. 29, 2003

(54) STABLE HYDROTROPIC SURFACTANTS COMPRISING ALKYLAMINO PROPIONATE

(76) Inventor: Lance L. Renfrow, 1330 W. Island Cir., Chandler, AZ (US) 85248

( * ) Notice: Subject to any disclaimer, the term of this patent is extended or adjusted under 35 U.S.C. 154(b) by 0 days.

(21) Appl. No.: 09/886,950

(22) Filed: Jun. 19, 2001

(65) Prior Publication Data

US 2002/0037821 A1 Mar. 28, 2002

Related U.S. Application Data

(60) Provisional application No. 60/212,699, filed on Jun. 19, 2000.

(51) Int. Cl.[7] ..... C11D 17/00

(52) U.S. Cl. ..... 510/218; 510/421; 510/424; 510/426; 510/477; 510/499

(58) Field of Search ..... 510/218, 424, 510/426, 428, 421, 499, 477

(56) References Cited

U.S. PATENT DOCUMENTS 6,277,801 B1 * 8/2001 Dahanayake et al. ..... 510/218
6,339,057 B1 * 1/2002 Knox et al. ..... 510/421

* cited by examiner

*Primary Examiner*—Necholus Ogden
(74) *Attorney, Agent, or Firm*—Drummond & Duckworth

(57) ABSTRACT

Detergent compositions containing at least two surfactants, one having a cloud point of less than about 30° C., especially below about 14° C., and another having a cloud point of greater than about 30° C., especially above about 40° C.

Methods of cleaning beer and food processing apparatus comprising applying these compositions also containing an alkali or acidic cleaner.

5 Claims, No Drawings

STABLE HYDROTROPIC SURFACTANTS COMPRISING ALKYLAMINO PROPIONATE

This application is a continuation-in-part of my provisional application Ser. No. 60/212,699, filed Jun. 19, 2000.

This invention relates to detergent compositions.

More particularly, the invention concerns detergent compositions that have an improved ability to defoam proteins compared the prior art, over a wide temperature range, with very low surface tension (i.e., below about 35 dynes/cm) and with excellent wetting properties at very high dilution rates.

In another aspect the invention provides a detergent composition that is easily soluble in and stable in an aqueous cleaning preparation containing a high concentration of sodium hydroxide, potassium hydroxide, phosphoric acid or hydrochloric acid.

In yet another respect, the invention concerns aqueous detergent-cleaner compositions, with enhanced wetting and defoaming properties, that are especially useful in cleaning food processing apparatus contaminated with protein deposits, for example, beer brewing apparatus, and apparatus used in processing diary and related food products.

According to another aspect of the invention, methods are provided for cleaning food processing equipment, using such cleaning compositions.

In its broadest aspect, the detergent composition includes a "low" cloud point surfactant (≦30° C., preferably ≦25° C.) and a "high" cloud point surfactant (≦30° C., preferably ≦25° C.). This combination of surfactants provides suitable defoaming characteristics over a wide range of temperatures.

According to the presently preferred embodiment of the invention, the surfactant compositions comprise a blend of component surfactant(s) which have cloud points below about 14° C. with surfactant(s) which have cloud points above about 40° C., for example:

| Component | Operable Weight % | Preferred Weight % |
|---|---|---|
| Mirataine ASC | 65–97 | 89.5 |
| Mirataine JC-HA | 1–20 | 5.0 |
| Antarox BL-240 | 1–10 | 3.0 |
| Antarox BL-214 | 1–5 | 2.5 |

The proportions of these components according to presently preferred embodiment of the invention are be:

| Surfactant* | Chemical Description |
|---|---|
| | (Hydrotropes) |
| Mirataine ASC | Alkylether Hydroxypropyl sultaine |
| Mirataine JC-HA | Alkylaminopropionate |
| | (Cloud Point ≦ 14° C. ≧ 40° C.) |
| Antarox BL-214 | Alcohols, ethoxylated, propoxylated |
| Antarox BL-240 | Alcohols, ethoxylated, propoxylated |

*Tradenames

The component "Mirataine ASC" is an amphoteric alkylether hydroxypropyl sultaine, as described in U.S. Pat. No. 4,891,159, incorporated herein by reference.

The component Mirataine JC-HA is an alkylamino propionate amphoteric surfactant commonly used as a hydrotrope.

The Antarox surfactants are alcohol alkoxylates with the structural formulae:

R-(ethylene Oxide)X-(propylene oxide)γ-OH.

wherein X=number of moles of ethylene oxide (EO) and γ=number of moles of PO. The R groups are C4-C20 linear alkyl groups. EO+PO≦20. The ratio of EO to PO is selected to obtain the desired cloud points. EO makes the molecule more water soluble (raises the cloud point) whereas PO makes the molecule less water soluble (lowers the cloud point).

Alternatively, considered in its broadest aspects, any surfactant which has a cloud point of ≧0° C. and ≦25° C. and could be substituted for Antarox BL-214 and any surfactants with a cloud point of ≦25° C. and ≧60° C. could be substituted for Antarox BL-240, although these Antarox surfactants are the preferred because they offer both quick breaking foam and good detergency and even more broadly one can use one surfactant with a cloud point of ≧0° C. and ≦60° C. However, the invention contemplates that all nonionics that fall within these ranges can be used.

In addition to alkylhydroxy propionic surfactant type surfactants, there are other surfactants which have the ability to hydrotrope defoaming surfactants such as BL-240 into 50% NaOH. These are certain polyglucosides. However these surfactants are less desirable compared to ASC type surfactants, because they are very thick and viscous, require a long mixing time solubilize into the NaOH and are quite foamy themselves. A good portion of the defoaming surfactant is wasted on defoaming the glucoside hydrotrope instead of defoaming deposits such as beer/protein deposits. Nevertheless, a formulation using one of them in place of the alkylhydroxy propionic surfactant is also within the scope of the invention. Commercially available examples include Mazon 40 (sucrose and glucose esters and derivatives, BASF Corp.) and Triton BG-10 (sucrose and glucose esters and derivatives, Union Carbide). The structure of these molecules is disclosed in U.S. Pat. No. 6,004,466 (Derian, Ventura, et al.), especially at the end of Column 3 and the beginning of Column 4.

Some Alternate Materials

JC-HA: Mackam LF050 (McIntyre) is a chemical match.

BL-214: Plurafac LF2240 (BASF) is a functional equivalent. Cloud Point=13° C.

BL214: Plurafac LF3140 equivalent, cloud point 8° C.

BL240: Plurafac LF2210 is a functional equivalent, cloud point=33° C.

Having described my invention in such terms as to enable those skilled in the art to understand and practice it, and, having identified the presently preferred embodiments thereof, I claim:

1. A detergent composition comprising:

an alcohol alkoxylate nonionic surfactant, having a cloud point less than 14 degrees Celsius and greater than 40 degrees Celsius; and an alkylamino propionate amphoteric.

2. The detergent composition of claim 1 further comprising:

an alkylether hydroxypropyl sultaine.

3. The detergent composition of claim 2 further comprising:

sodium hydroxide.

4. The detergent composition of claim 1 further comprising:

a polyglucoside.

5. The detergent composition of claim 4 further comprising:

sodium hydroxide.

* * * * *